United States Patent [19]

Beney et al.

[11] Patent Number: 4,497,378

[45] Date of Patent: Feb. 5, 1985

[54] DRILLING AND BOLTING TURRET

[75] Inventors: Gilbert Beney, Meyzieu; Michel Combet, Beynost Miribel, both of France

[73] Assignee: Eimco-Secoma Societe Anonyme, Meyzieu, France

[21] Appl. No.: 462,989

[22] Filed: Feb. 1, 1983

[30] Foreign Application Priority Data

Feb. 2, 1982 [FR] France ..... 82 02109

[51] Int. Cl.[3] ..... E21C 11/00

[52] U.S. Cl. ..... 173/32; 173/31/52; 405/259

[58] Field of Search ..... 173/31, 32, 34, 52, 173/38, 29, 44, 50, 147; 405/259, 303; 175/122, 173

[56] References Cited

U.S. PATENT DOCUMENTS

| | | | |
|---|---|---|---|
| 3,246,705 | 4/1966 | Chappuis | 173/44 |
| 3,563,321 | 2/1971 | Barendsen et al. | 173/38 X |
| 4,105,081 | 8/1978 | Perraud | 175/122 |
| 4,215,953 | 8/1980 | Perraud | 405/259 X |

FOREIGN PATENT DOCUMENTS

| | | | |
|---|---|---|---|
| 149396 | 7/1981 | Fed. Rep. of Germany | 405/259 |
| 1359297 | 3/1964 | France | 173/44 |
| 160488 | 1/1964 | U.S.S.R. | 173/34 |
| 934038 | 6/1982 | U.S.S.R. | 405/259 |

*Primary Examiner*—William R. Briggs
*Assistant Examiner*—Lawrence H. Meier
*Attorney, Agent, or Firm*—Karl F. Ross

[57] ABSTRACT

A turret for mining appliances comprises a girder serving as a guide for a drilling carriage and a bolting carriage, which is mounted to pivot and slide along an axis at the end of a support arm. The girder is integral with two bearings, mounted to rotate freely and to slide on a tube provided with an anchoring point and integral with a support box articulated on the arm. The two bearings are connected by a second tube which passes through a connecting-rod which is mounted to rotate but prevented from moving longitudinally on the first tube, the pivoting of the turret being controlled by a jack pivotally connected on the one hand to the box and on the other hand to the connecting-rod. The withdrawal of the girder is controlled by another jack housed partly in the first tube.

19 Claims, 6 Drawing Figures

DRILLING AND BOLTING TURRET

CROSS REFERENCE TO RELATED APPLICATIONS

While this application is not directly related to any specific prior applications, work of the present assignee has resulted in a number of applications and patents in this field which may be considered relevant or material. These applications include Ser. No. 161,419 filed June 20, 1980, Ser. No. 190,165 filed Sept. 23, 1980 as a continuation-in-part of Ser. No. 947,322 of Oct. 2, 1978, and Ser. No. 199,683 of Oct. 22, 1980. U.S. Patents which may likewise be considered to be relevant are U.S. Pat. Nos. 4,105,081, 4,291,771, 4,226,449 and 4,300,642.

FIELD OF THE INVENTION

Our present invention relates to a drilling and bolting turret and, more particularly, to a turret for a machine generally for subterranean use, e.g. in a mine tunnel, capable of drilling a borehole in a rock face or structure and inserting a bolt into the hole.

BACKGROUND OF THE INVENTION

In subterranean engineering, i.e. the construction of tunnels, galleries or shafts, it is frequently desirable to stabilize the excavated structure by anchoring wall or support members thereto and, for this purpose, drilling and bolting machines have been developed as, for example, will be apparent from the aforementioned applications and patents.

The procedure which can be carried out with the aid of such machines involves the drilling of a so-called borehole and the subsequent anchoring of a bolt therein. Frequently the anchoring of the bolt can be effected at least in part by introducing into the hole in which the bolt is inserted, a hardenable synthetic resin mass, especially a thermosetting synthetic resin.

The drilling and bolting turret can have a girder mounted to pivot about a pivot pin at the end of a support arm and comprising means for guiding the sliding of two carriages in a direction parallel to the pivoting axis of the girder, one carriage being for drilling a hole and the other for the introduction of a bolt into the hole drilled and for its tightening, as well as means for controlling the advance and withdrawal movements of the two carriages, means such as a jack being provided for controlling the pivoting of the girder in order to bring the second carriage into line with the axis of the hole drilled previously by the first carriage, whereas other means such as a jack are provided for moving the arrangement of the girder longitudinally parallel to its pivot axis.

A turret of this type, which is used in the field of mining, in particular for the work of supporting the "roof" and the "faces" of a mine-level, is already described for example by French Pat. No. 1 359 297. This turret is equipped to drill a hole by means of the first carriage which drives a drilling bit and then in order to introduce a bolt into the hole and tighten it by means of the second carriage, constituting a screwing device. Anchoring of the apparatus to the "roof" or "face" of the level is carried out along the pivoting axis of the turret, in order that before it is fitted, the axis of the bolt corresponds exactly to the axis of the hole drilled. A turret of this type is advantageously associated with a bolt magazine, in order to be able to drill a series of holes and introduce bolts into the latter virtually without manual intervention.

In the construction known from French Pat. No. 1 359 297, the girder is integral with two bearings mounted to slide on a tube, which is mounted to pivot at the end of the support arm. The jack controlling pivoting is hinged at a wrist-pin integral with the tube and a rotary connection by cotter-pins allows the girder to rotate at the same time as the tube, whilst allowing sliding of the girder parallel to its pivot axis. The anchoring along this pivot axis is achieved by a point integral with the tube and the jack for so called full retraction or advance which controls the sliding of the girder along this tube forms an integral part of the structure. This entire arrangement has various drawbacks:

(a) owing to the rotation of the tube, the wear is considerable and the positioning lacks precision.

(b) the presence of cotter-pins prevents the use of gaskets.

(c) the pivoting of the anchoring point, with the turret arrangement, brings about crumbling of the "roof" or of the "face", thus resulting in poor anchorage.

(d) the travel of the jack for full retraction or advance is limited.

Furthermore, in the known turret construction to which reference is made, the girder has an "H" section and the means for guiding the two carriages are constituted by the two parallel flanges of this girder. The guide surfaces are relatively weak and cannot be replaced in the case of wear. In addition, this arrangement reduces visibility from the operator's working position.

OBJECTS OF THE INVENTION

It is the principal object of the present invention to provide a drilling and bolting turret which obviates the drawbacks enumerated above and to improve upon the earlier bolting and drilling turrets.

A more specific object of the invention is to provide a drilling and bolting turret with more precise positioning of the drilling and bolting carriages, which eliminates the need for twisting of the anchor point, and which has a high degree of travel time, whereby the versatility of the system is increased.

Still another object of the invention is to provide a drilling and bolting turret of an improved design which does not obstruct the operator's visibility and is also significantly more reliable structurally and functionally than earlier systems.

SUMMARY OF THE INVENTION

These objects and others which will become apparent hereinafter are attained, in accordance with the present invention, in a bolting and drilling turret which comprises a support which can be carried by any conventional manipulator for movement toward a subterranean wall adapted to the provided with bolts in the manner described and preferably a C-shaped member, one end of which is connected to the manipulator while the other end thereof carries the rotating members of the turret.

According to this invention, the other end of this C-shaped support is fixed to an elongated cylindrical member carrying a fixed anchor point adapted to be seated in the face of the wall to be drilled and bolted and movable thereagainst by the manipulator.

This cylindrical member carries a girder forming a longitudinal guide for a pair of carriages parallel to the cylindrical member, the remainder being mounted on the cylindrical member with a pair of longitudinally spaced bearings enabling the girder to be swung around the cylindrical member and to move axially therealong. For the latter movement, a piston-and-cylinder means is provided at least in part within the cylindrical member while the swinging movement is effected by coupling the girder assembly with a further piston-and-cylinder arrangement connected to the support. Preferably the two bearings are also connected fixedly to a further cylindrical member extending parallel to the first cylinder member and longitudinally slidable with respect to a connecting element of the latter hydraulic means.

According to the present invention, therefore, the drilling and bolting turret can be constituted by a girder mounted to pivot about an axis at the end of a support arm and comprising means for guiding two carriages as they slide, in a direction parallel to the pivoting axis of the girder, one carriage being for drilling a hole and the other for the introduction of a bolt into the hole drilled and for its tightening, as well as means for controlling the advance and withdrawal movements of the two carriages, means such as a jack being provided for controlling the pivoting of the girder in order to bring the second carriage into line with the axis of the hole drilled previously by the first carriage, whereas other means such as a jack are provided for moving the girder arrangement longitudinally, parallel to its pivot axis.

According to the invention a tube or cylindrical rod is provided with the anchoring point and is integral with a member such as a support box supported by the manipulator arm, whereas the girder comprising the guide means for the two carriages is integral with two bearings, mounted to rotate freely and to slide on the tube or rod, these two bearings being interconnected by a second tube or a second cylindrical rod parallel to the girder, the jack for controlling the pivoting of said girder being pivotally connected to a connecting rod mounted to rotate, but prevented from moving longitudinally on the tube or cylindrical rod integral with a member such as a box, a tube or cylindrical rod integral with the girder passing through the connecting-rod, with the possibility of sliding.

The turret according to the invention is thus composed of a tube or rod which is fixed with respect to its support box, mounted on which tube is a frame formed by the girder, by the two bearings and by the other tube or rod, which is able to rotate and move longitudinally. The guides are thus produced for the desired pivotal and longitudinal movements of the girder, while locating the anchoring point on a part which is fixed with respect to the support box.

The jack for controlling pivoting acts through the intermediary of a connecting rod which rotates about the tube or the fixed rod and which whilst moving the other tube or rod causes the entire aforesaid frame to pivot about the first tube or the first rod. As regards the longitudinal movement of the girder, the latter may be controlled by a second jack, the body of which is housed at least partly in the fixed tube or cylindrical rod, to which it is connected and the rod of which is integral with the girder at its outer end.

In contrast to the drawbacks mentioned above, the turret arrangement proposed thus has the following advantages, while remaining simple:

(a) Reduction of wear and more precise positioning, (b) Owing to the elimination of the cotter pins, the possibility of using gaskets and the possibility of scraping.

(c) Anchorage by a point which does not pivot with the girder, since it is supported by a fixed member, thus giving rise to more effective anchoring.

(d) Control of the longitudinal movement of the girder by an independent jack, with greater travel.

Preferably, the means for guiding the two carriages as they slide are constituted, for each carriage, by two parallel guides each comprising three useful or effective faces coming into contact with shoes of complementary shape supported by the carriage, two of the faces of each guide being parallel whereas the third is perpendicular or substantially perpendicular thereto and each shoe comprising a U-shaped groove through which the corresponding guide may pass.

The multiplication of the number of faces improves the guidance of the carriages and reduces wear, the special shape of the shoe enabling it to always have at least three faces in contact with the corresponding guide, instead of a single face in the case of the former construction mentioned above. The shape of squares at an angle also makes it possible to keep the drill in the median plane of the guide and thus to facilitate the alignment of the bolt with respect to the hole drilled previously. Due to the large contact surface which it provides, this guide device makes it possible to eliminate any system for taking up play, which is fragile (numerous regulating members), troublesome and which easily looses its adjustment.

Advantageously, the two parallel guides provided for the sliding of a carriage are constituted by the two lateral parts of the same rail mounted in a removable manner on the girder, the useful faces of these guides being located in planes inclined at an angle of 45° with respect to the plane of the web of the rail. The girder thus supports two removable rails, which can easily be replaced at less expense, in the case of wear.

The respective webs of the two rails supported by the girder are preferably located in planes which are not parallel, for example, forming an angle of approximately 60°, which has the result of improving the visibility from the operator's working position towards the drilling line.

Still with the aim of increasing visibility, the support box, to which the tube of cylindrical rod provided with the anchoring point is fixed, advantageously has a swan-neck shape.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
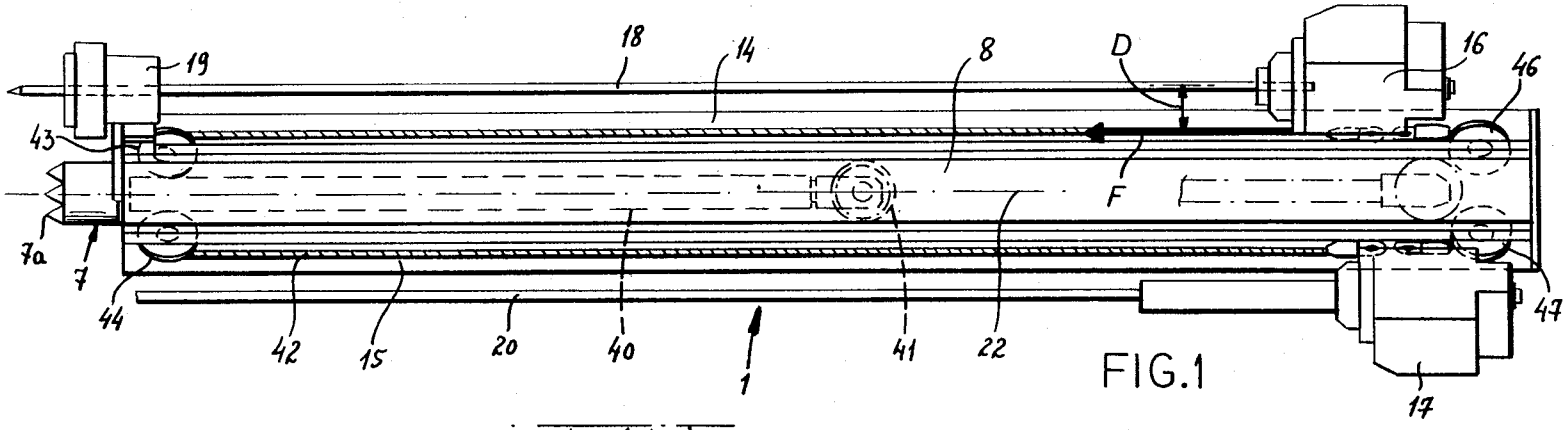
FIG. 1 is a front view of a turret according to the present invention, shown with its two carriages.
Figure 2:
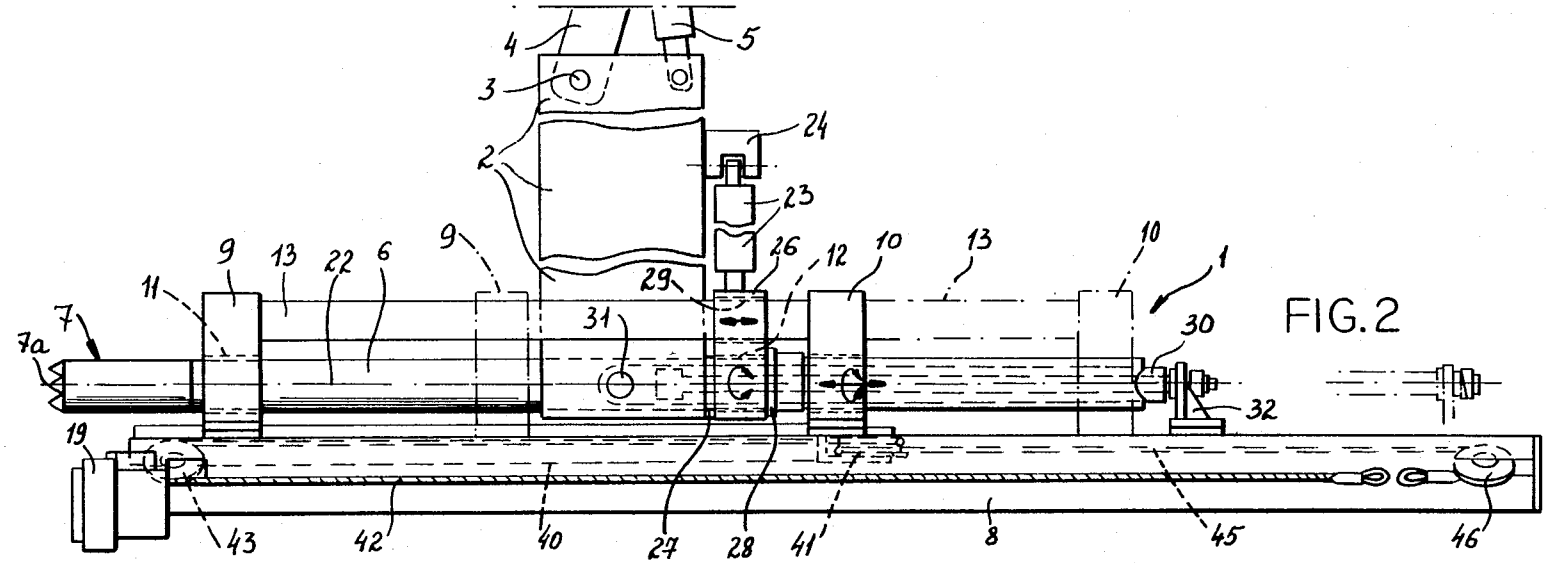
FIG. 2 is a side view of the turret of FIG. 1, showing a withdrawn position of the girder, the carriages not being shown.
Figure 3:
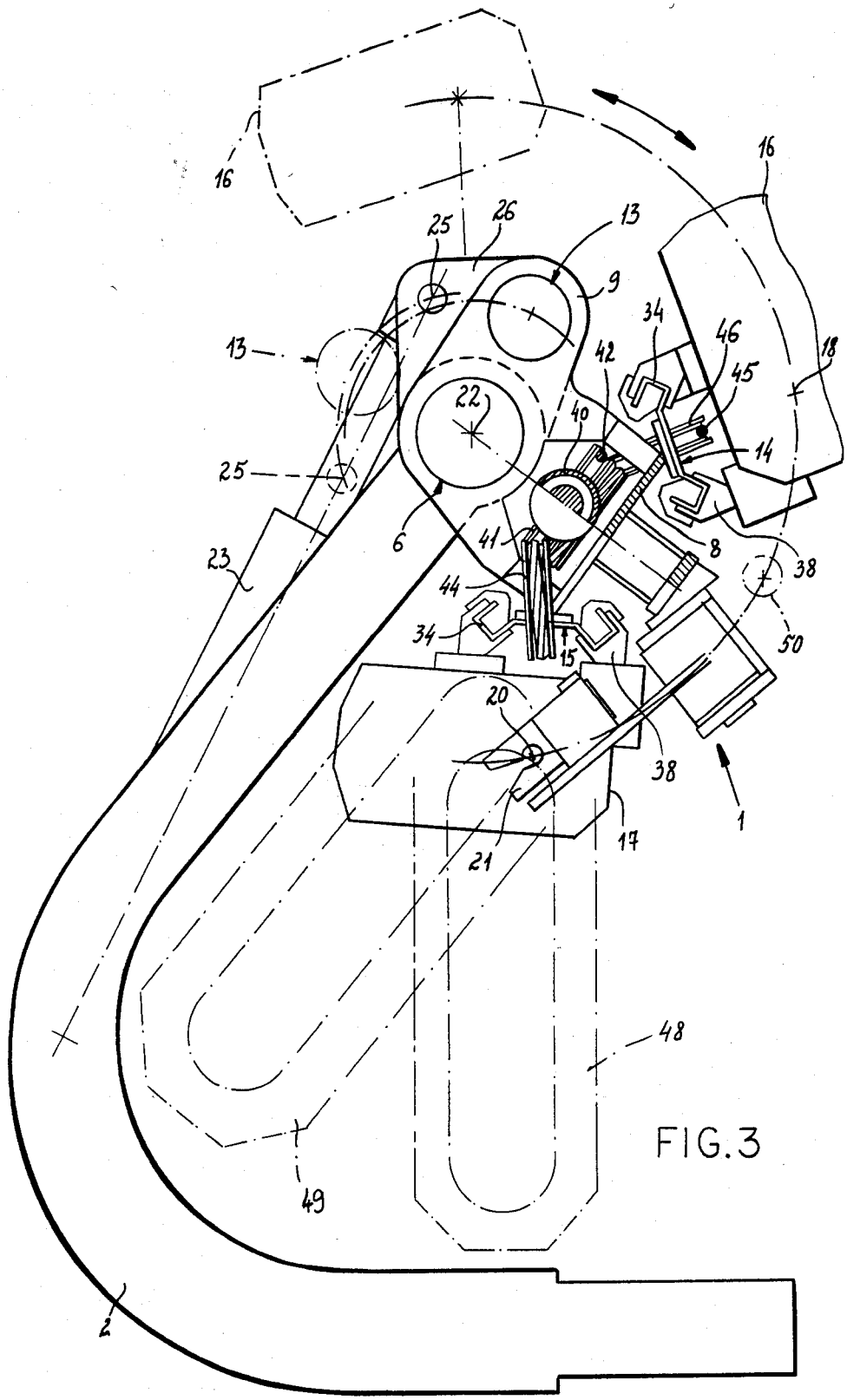
FIG. 3 is an end view of this turret, with partial sections, in the drilling position and with a rough indication of the bolting position.

FIGS. 1 to 3 show a drilling and bolting turret, designated generally by the reference numeral 1, which is assumed to be arranged horizontally. This turret 1 is supported by a support box 2 having a swan-neck or C-shape and which is, in turn, mounted to tilt about a pivot 3 at the end of a support arm 4 carried by a mining appliance. The tilting movement about the pivot 3 is controlled by a jack 5 (see FIG. 2 in particular).

At its end remote from the pivot point 3, the support box 2 supports a cylindrical shaft constituted by a tube 6, this tube being integral with the box 2 both as regards longitudinal movement and rotation. An anchoring point 7 is fixed to one end of the tube 6 and has a multiplicity of points 7*a* which prevent rotation when they are seated in a gallery or tunnel wall.

The pivoting part of the apparatus is constituted by a girder 8, which extends parallel to the tube 6 and which is integral with two bearings 9 and 10 mounted to rotate freely and to slide, through the intermediary of respective guide rings 11 and 12, on the tube 6. The two bearings 9 and 10 are located on either side of the support box 2 and are interconnected by a second tube 13, which is parallel to the first tube 6 and to the girder 8. This girder 8 supports two removable rails 14 and 15, for guiding the two carriages 16 and 17 as they slide. The first carriage 16 constitutes a drill equipped with a drilling bit 18, which is able to pass through a dust-collecting box 19 supported by one end of the girder 8. The second carriage 17 constitutes a screwing device for tightening a bolt 20, which may be guided in retractable grippers 21 (see FIG. 3), mounted to pivot on the girder 8.

The frame-like arrangement, constituted by the girder 8 and the two bearings 9 and 10 interconnected by the tube 13, with the carriages 16 and 17 and the other accessories mentioned above, is able to slide along the tube 6 and to rotate about the axis 22 of this tube 6, guided in these two movements by the respective rings 11 and 12 of the bearings 9 and 10.

In order to control the pivoting of this arrangement about the axis 22, a jack 23 is provided, which the body (FIG. 2) is pivoted on a clevis 24 fixed to the box 2 and the rod of which is pivoted along an axis 25 on a connecting element or plate 26, which is mounted to rotate on the first tube 6, but prevented from moving longitudinally on the latter by two flanges 27 and 28. The connecting plate 26 comprises a bore 29 through which the second tube 13 passes, sliding of this tube 13 relative to the connecting-rod 26 being possible. According to whether the jack 23 is extending or retracting, the connecting plate 26 is set in rotation in one direction or the other about the first tube 6.

Through the intermediary of the second tube 13, this connecting plate 26 causes the entire arrangement constituted by the girder 8, the bearings 9 and 10 and the tube 13 to pivot about the axis 22, whatever the longitudinal position of this arrangement. The pivot axis 22 is kept fixed in space by virtue of the anchorage achieved by the point 7, which is prevented from rotating as noted.

The longitudinal arrangement along the tube 6 of the arrangement constituted by the girder 8, the bearings 9 and 10 and the tube 13 is controlled by a jack 30, the body of which is housed in the tube 6 and fastened to this tube 6 at 31. The rod of the jack 30, projecting outside the tube 6 at the end remote from the point 7, is connected to a fastening member 32 fixed to the girder 8. The most advanced position of the arrangement in question is shown in FIG. 2, in full line, which position is obtained when the rod of the jack 30 is retracted and the most retracted position of this arrangement is shown in dot dash lines, which position is obtained when the rod of the jack 30 is completely extended.

Figure 4:
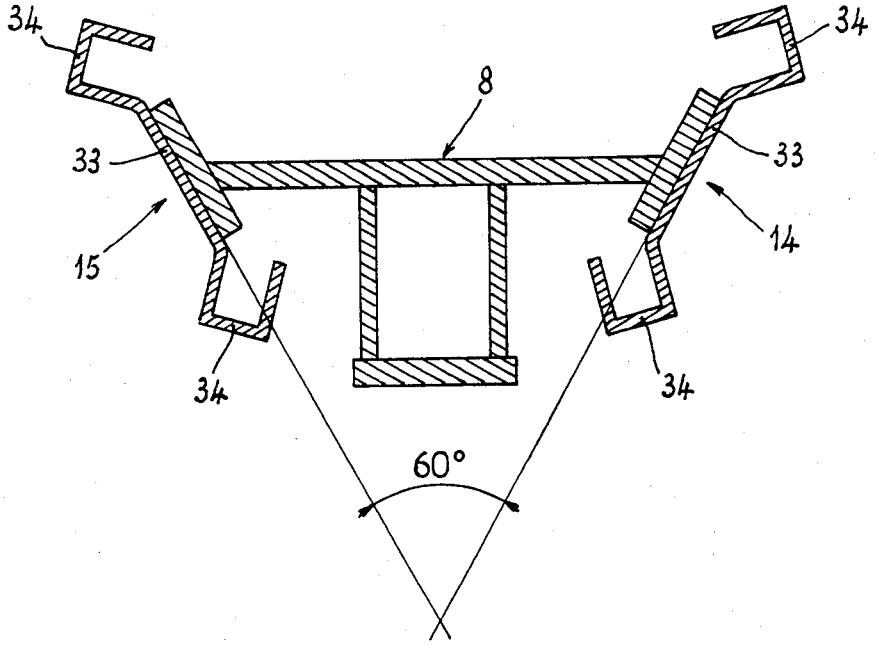
FIG. 4 is a detailed view, showing the profile of the girder and of the two rails for guiding the carriages.
Figure 5:
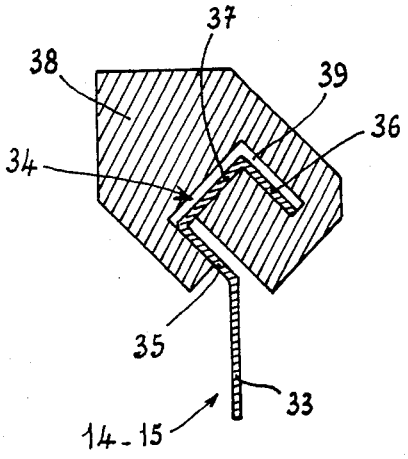
FIG. 5 is a partial sectional view of a rail, passing through the front part of a shoe supported by one of the carriages.
Figure 6:
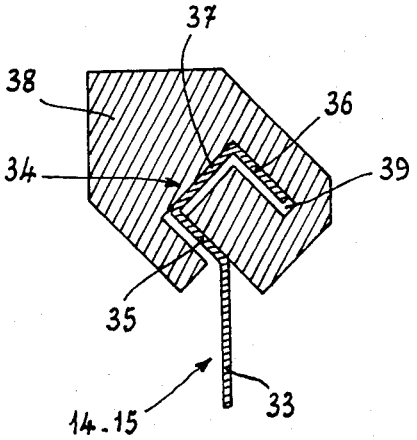
FIG. 6 is a view similar to FIG. 5, but passing through the rear part of the same shoe.

As shown in FIG. 3 and above all in FIGS. 4 to 6, the two rails 14 and 15 supported by the girder 8 each comprise a central web 33 and two symmetrical lateral guides 34, each guide 34 is in turn composed of two parallel parts 35 and 36 interconnected by a part 37 which is perpendicular thereto, the three parts 35, 36 and 37 all being located in planes inclined at 45° with respect to the plane of the web 33 of the rail 14 or 15. As shown in FIG. 4, the webs 33 of the two rails 14 and 15 are located in planes which form an angle of approximately 60°.

Each of the carriages 16 and 17 are provided with two guide shoes 38 cooperating respectively with the two guides 34 of the corresponding rail 14 or 15. To this end, each shoe 38 comprises a longitudinal groove 39 of U-shaped profile, complementing the profile of the guide 34 which passes through said groove 39.

Referring to FIG. 1 and considering the carriage 16 constituting a drill, it will be noted that the pulling or pushing force F on this carriage 16 results in torque, equal to the product of this force F and the distance D between the line of application of this force (cable or chain) and the drilling bit 18. This torque tends to "lift" the carriage 16 on the rail 14. The particular shape of the guides 34 of this rail and of the shoes 38 of the carriage makes it possible to always have three faces of the shoe 38 in contact with the guide 34, under the effect of this torque. These three faces in contact are not the same in the front part of the shoe 38 (see FIG. 5) and in its rear part (FIG. 6). The internal guidance on two faces in a V shape, at the front of the shoe 38, provides a self-centering effect and also has the result that the nose of the drill has less tendency to lift.

In the embodiment shown here, the advance or withdrawal of the two carriages 16 and 17, guided along respective rails 14 and 15 by the means which have been described, is obtained in known manner by a single common drive member, constituted by a jack 40 housed between the tube 6 and the girder 8. The body of the jack 40 is connected to the girder 8 and its rod moves a pulley 41 comprising a groove through which a cable 42 passes, which also passes over two return pulleys 43 and 44 and the ends of which are attached respectively to the two carriages 16 and 17. When one of the carriages is immobilized and the jack 40 is extended, the other carriage is moved forward. The withdrawal of one or other of the carriages 16 and 17, controlled by the retraction of the jack 40, is ensured through the intermediary of a reverse device, constituted by another sheave cable 45 passing in a second groove of the pulley 41 as well as over two return pulleys 46 and 47, its ends also being attached to the carriages 16 and 17.

Finally, referring mainly to FIG. 3, the operation of the turret arrangement aforedescribed will be recalled:

The turret is initially anchored to the rock by the point 7 of the tube 6, using the movements of the support arm 4. The girder 8 is first of all placed, by means of the jack 23 controlling its pivoting about the axis 22, in its drilling position shown in continuous line in FIG.

3, for which the axis of the bit 18 corresponds to that of the hole to be drilled. By sliding along the axis 22, controlled by the jack 30, the girder 8 is also advanced until the dust-collecting box 19 comes into contact with the rock. The first carriage 16 is actuated in order to drill the hole by means of the bit 18. Then, this carriage 16 is withdrawn, then the girder 8 itself is withdrawn and the jack 23 controls the pivoting of the girder 8 about the axis 22, until the bolt 20 supported by the second carriage 17, arrives in line with the axis of the hole drilled previously. The second carriage 17 is then actuated in order to introduce the bolt 20 into the hole and to bring about its tightening. After the withdrawal of this second carriage 17, the girder 8 may be returned to its initial angular position and a new cycle may begin. A bolt magazine 48 or 49, carried by the support box, makes it possible to carry out several cycles in succession without manual intervention on the turret 1.

In the case where the bolts are replaced by rods sealed in resin, the girder 8 also comprises a channel 50 for the injection of resin, located between the two carriages 16 and 17 on the same circle, centered on the axis 22, as the drilling bit 18. The girder 8 is stopped in an intermediate angular position in order to carry out the injection of resin after the hole has been drilled.

Naturally, the invention is not limited to the single embodiment of this drilling and bolting turret which was described above, by way of example. On the contrary, it includes all variations of construction and application based on the same principle. Thus, it would not be outside the scope of the invention to use solutions other than that described for the construction of the means controlling the advance and withdrawal movements of the two carriages 16 and 17.

We claim:

1. A drilling and bolting turret comprising:

a support having two ends, one of said ends being connectable to an arm for positioning the turret;

a first cylindrical member mounted on said support at the other end thereof and formed at one of its extremities with an anchoring point adapted to be seated in a wall for preventing rotation of said first cylindrical member;

a pair of bearings axially spaced apart and rotatable on said first cylindrical member while being axially slidable therealong;

a girder fixed on said bearings and extending parallel to said first cylindrical member;

a drilling carriage longitudinally shiftable on said girder for drilling a hole in said wall, and a bolting carriage longitudinally shiftable on said girder for inserting a bolt in a hole drilled by said drilling carriage;

means on said girder for longitudinally shifting said carriages therealong;

means for longitudinally sliding said girder relative to said support;

a second cylinder member fixed to said bearings and movable therewith upon axial displacement of said bearings and said girder relative to said first cylindrical member;

a connecting element swingably mounted on said first cylindrical member and slidably receiving said second cylindrical member; and a fluid-responsive piston-and-cylinder arrangement operatively connected to said support and said connecting element for angularly displacing the connecting element about the axis of said first cylinder member, thereby rotating said turret about said axis and selectively positioning said carriages with respect to said wall.

2. The turret defined in claim 1 wherein means are provided to prevent said connecting element from moving longitudinally upon said first cylindrical member.

3. The turret defined in claim 2 wherein said first member is a tube.

4. The turret defined in claim 2 wherein said first member is a rod.

5. The turret defined in claim 2 wherein said second member is a tube.

6. The turret defined in claim 2 wherein said second member is a rod.

7. A drilling and bolting turret according to claim 1 wherein the two bearings connected with the girder are located on either side of said support.

8. A drilling and bolting turret according to claim 1 wherein the longitudinal movement of the girder is controlled by a jack with a body housed at least partly in and connected to said first cylindrical member, with said jack including a rod connected to said girder.

9. A drilling and bolting turret according to claim 1 wherein for each carriage there are provided guide means for guiding the carriage on said girder, the guide means comprising two parallel guides each comprising three useful faces coming into contact with shoes of complementary shape supported by the carriage, two of the faces of each guide being parallel, whereas the third face is perpendicular or substantially perpendicular thereto and each shoe comprising a U-shaped groove through which the corresponding guide may pass.

10. A drilling and bolting turret according to claim 9 wherein the two parallel guides provided for the sliding of a carriage are constituted by the side parts of the same rail mounted in a removable manner on the girder, the useful faces of these guides being located in planes inclined at 45° with respect to the plane of the web of the rail.

11. A drilling and bolting turret according to claim 10 wherein the respective webs of the two rails are located in planes which are not parallel.

12. A drilling and bolting turret according to claim 11 wherein the respective webs of the two rails are located in planes which form an angle of approximately 60°.

13. A drilling and bolting turret according to claim 1 wherein the support which is affixed to the first cylindrical member has a swan-neck shape.

14. A drilling and bolting turret according to claim 9 wherein the support which is affixed to the first cylindrical member has a swan-neck shape.

15. A drilling and bolting turret according to claim 10 wherein the support which is affixed to the first cylindrical member has a swan-neck shape.

16. A drilling and bolting turret according to claim 11 wherein the support which is affixed to the first cylindrical member has a swan-neck shape.

17. A drilling and bolting turret according to claim 12 wherein the support which is affixed to the first cylindrical member has a swan-neck shape.

18. A drilling and bolting turret according to claim 12 wherein the longitudinal movement of the girder is controlled by a jack with a body housed at least partly in and connected to said first cylindrical member, with said jack including a rod connected to said girder.

19. A drilling and bolting turret according to claim 18 wherein the two bearings connected with the girder are located on either side of said support.

* * * * *